US008127587B2

(12) United States Patent
Hughes

(10) Patent No.: US 8,127,587 B2
(45) Date of Patent: Mar. 6, 2012

(54) EMERGENCY FLOW STOPPAGE TOOL

(76) Inventor: Thomas Michael Hughes, Hastings-on-Hudson, NY (US)

( * ) Notice: Subject to any disclaimer, the term of this patent is extended or adjusted under 35 U.S.C. 154(b) by 957 days.

(21) Appl. No.: 11/982,798

(22) Filed: Nov. 5, 2007

(65) Prior Publication Data

US 2008/0134747 A1 Jun. 12, 2008

Related U.S. Application Data

(63) Continuation-in-part of application No. 11/696,446, filed on Apr. 4, 2007.

(60) Provisional application No. 60/860,612, filed on Nov. 22, 2006, provisional application No. 60/872,318, filed on Dec. 2, 2006.

(51) Int. Cl.
*B25B 7/00* (2006.01)
*B25B 7/14* (2006.01)

(52) U.S. Cl. ..... 72/409.01; 81/331

(58) Field of Classification Search ..... 72/409.01, 72/409.11, 409.12, 409.13, 409.19, 416, 72/479; 81/319, 320, 324, 331, 332
See application file for complete search history.

(56) References Cited

U.S. PATENT DOCUMENTS

| | | | | | |
|---|---|---|---|---|---|
| 2,435,562 | A * | 2/1948 | Swengel | ..... | 72/409.11 |
| 3,181,341 | A * | 5/1965 | Thornton et al. | ..... | 72/409.11 |
| 4,729,170 | A * | 3/1988 | Hartmeister | ..... | 72/409.01 |
| 5,058,414 | A * | 10/1991 | Hayes | ..... | 72/409.19 |
| 6,164,106 | A * | 12/2000 | Nghiem et al. | ..... | 72/416 |

* cited by examiner

*Primary Examiner* — Teresa Ekiert
(74) *Attorney, Agent, or Firm* — Jack Schwartz & Associates, PLLC

(57) ABSTRACT

The tool reduces or stops the flow of liquid or gas through a conduit and includes a crimping section, comprised of a first and second crimping member pivotally engaged with each other, and a handle section, comprised of a first and second handle member pivotally connected to each other. Each crimping member has a blunt section extending partially along an edge thereof. The first and second handle members are connected to the first and second crimping members. The conduit is crimped by applying a force to the handle members causing the handle members and the crimping members to pivot in a direction opposite each other so that the blunt sections of crimping members crimp a conduit placed therebetween thereby reducing or stopping the flow of the liquid or gas flowing through the conduit. The tool may also hold objects and be locked via separate locking mechanisms.

12 Claims, 11 Drawing Sheets

Emergency Flow Stoppage Tool

TOOL 1

Emergency Flow Stoppage Tool
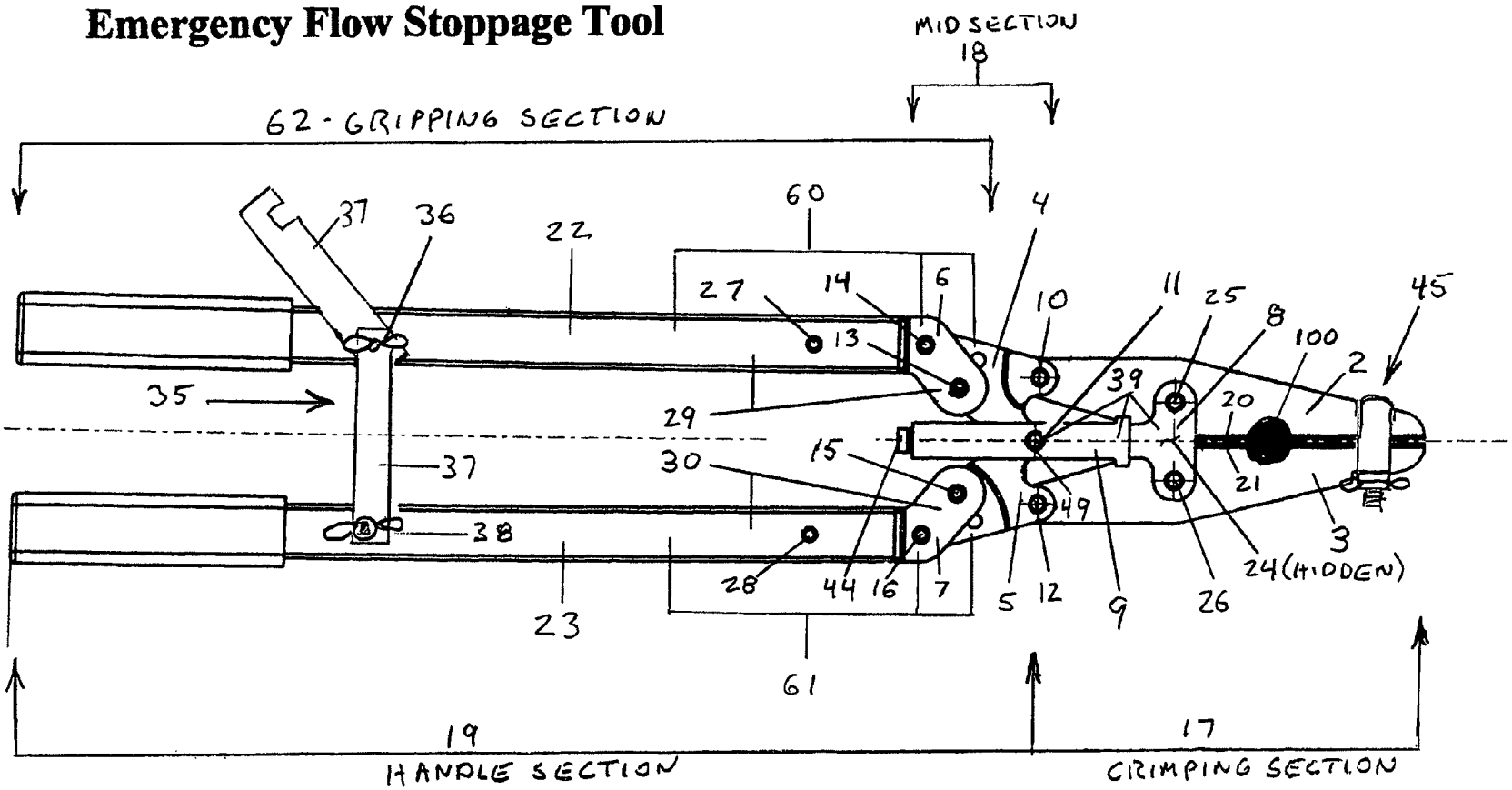
FIG. 1 - TOOL 1

FIG. 5 - LOCK BAR 8

FIG. 6 - LOCK BAR 9

EMERGENCY FLOW STOPPAGE TOOL

CROSS-REFERENCE TO RELATED APPLICATIONS

This application is a Continuation in Part of a patent application with Ser. No. 11/696,446 filed on Apr. 4, 2007 that claims priority from Provisional Patent Application Ser. No. 60/860,612 filed on Nov. 22, 2006 and Provisional Patent Application Ser. No. 60/872,318 filed on Dec. 2, 2006

FIELD OF INVENTION

The present invention relates to tools and, more specifically, to a tool for selectively preventing the flow of liquid and/or gas through a conduit.

BACKGROUND OF THE INVENTION

In the construction, contracting and facility management industries, different groups of people work on different areas of a project in order to build, repair or maintain a structure. The structure typically has many component systems such as structural components, electrical systems, heating and ventilation systems and plumbing. Each of these systems are designed to perform certain functions but, when working together, combine to provide for a fully functional structure. When building or repairing these structures, accidents or failures in existing systems may occur where one system is interrupted or damaged while working on it or on a different system. In the event that the damage occurs to the plumbing or piping system, the damage resulting therefrom may be extensive. For example, water flowing out of a damaged section of a live pipe could damage the structural or electrical systems as well as building finishes (furniture, carpeting, etc) and personal items which are proximate to the cracked pipe. Additionally, another problem occurs when the structure is large in scale (a high-rise building, for example) and the location of the emergency shut-off for the plumbing system may be located far away from the damaged piping, difficult to find or inoperable. This may lead to prolonged exposure and extensive damage to the structure from any liquids traveling out from the damaged section of a live pipe. Therefore, a need exists for a tool that could stop or reduce the flow of liquid or gas through a conduit in order to reduce and/or stop the flow of the liquid or gas out of the damage section of the pipe, thereby quickly preventing and/or reducing the damage to the surrounding structure, systems, finishes and other items positioned nearby. There is a further need to provide a tool that does not sever or cut the conduit but rather closes off the conduit to prevent any additional water or liquid from passing therethrough. A tool according to the invention principles satisfies these needs and remedies the above-noted drawbacks.

BRIEF SUMMARY OF THE INVENTION

The Emergency Flow Stoppage Tool is a portable tool for use in quickly stopping or reducing the flow of liquid and/or gas through a broken or cracked malleable conduit. The tool includes a handle section, comprising two handles members, and a crimping section comprising two crimping members. The user may stop or reduce the flow of liquid and/or gas through a conduit by gripping the tool with two hands such that when force is applied to the handle section, the crimping members are caused to squeeze the conduit therebetween and effectively close the conduit. The tool may be placed just upstream or remotely upstream of the broken conduit and may be may be locked in place via locking mechanisms, ensuring a substantial reduction in flow or full flow stoppage. Portions of the handle members can each be removed from the tool to reduce the amount of weight being held by the conduit. The removal of portions of the handle members advantageously prevents further damage to the weakened or cracked conduit due to the weight of the tool.

An object of The Emergency Flow Stoppage Tool is to reduce and/or stop the flow of liquid or gas flowing out of a damaged section of conduit in order to minimize the associated damage and to provide the user enough time to find a permanent manner to stop the flow of liquid or gas through the conduit. The Emergency Flow Stoppage Tool achieves this objective by quickly crimping a section of broken conduit, thereby reducing the flow of gas or liquid in the conduit and out of the damaged section of conduit and by locking the tool in place so the user may take the time required to find a permanent method to stop the flow of liquid or gas in the conduit.

BRIEF DESCRIPTION OF THE DRAWINGS FIGURES

In order that the invention may be more fully understood, it will now be described, by way of example, with reference to the accompanying drawing in which:

FIG. 1 is a front view of the Emergency Flow Stoppage Tool according to invention principles;

DETAILED DESCRIPTION OF THE INVENTION

Figure 2A:
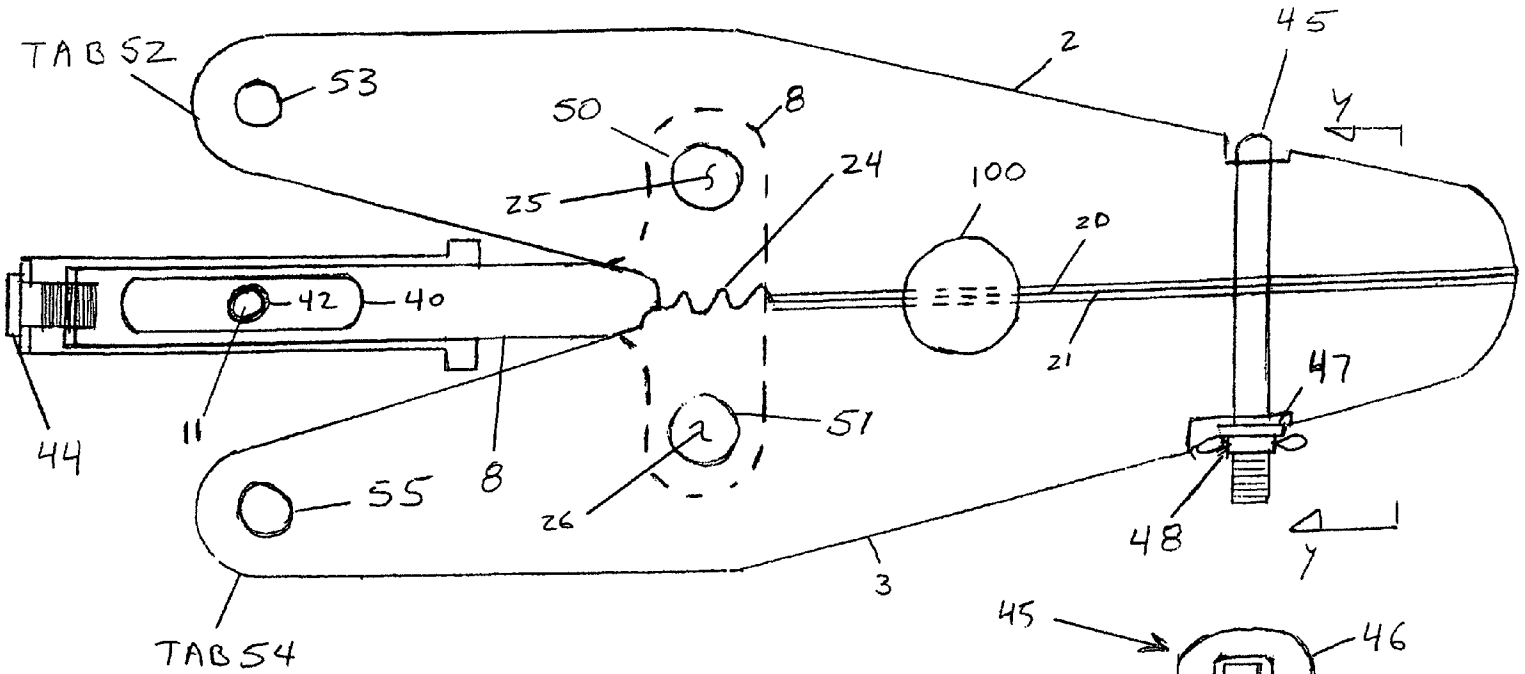
FIGS. 2A & 2B are front views of the crimping section, taken with the illustrative removal of the front side of lock bars 8 and 9, and an exploded view of the crimping section's locking mechanism of the Emergency Flow Stoppage Tool according to invention principles.

The following discussion describes in detail the invention. This discussion should not be construed, however, as limiting the invention to that particular embodiment. Practitioners skilled in the art will recognize numerous other embodiments as well.

Turning now to the drawings, in which similar reference characters denote similar elements throughout the several views, FIGS. 1 through 14 illustrate an Emergency Flow Stoppage Tool which is indicated generally by the reference numeral 1.

The emergency flow stoppage tool 1 shown in FIGS. 1-14 may be a hand-held and hand operated tool for use in quickly reducing or preventing the undesired flow of liquids, gases or other substances through a conduit that is cracked or broken. The term conduit as used herein may define a pipe, tube, duct or any other structure able to transport a liquid or a gas. The terms liquid and gas may be used interchangeably throughout the application and also may include any other substance readily transportable via a conduit. The tool 1 crimps a small section of the conduit upstream from the damaged section. The crimping action performed by the tool substantially reduces or prevents the flow of liquid through the damaged section of the conduit. Alternatively, the tool 1 may be used to either stop the flow of liquid in a non-damaged pipe or to narrow the opening of the conduit such that the amount of liquid passing through the conduit is reduced thereby reducing the rate at which the liquid flows through a section of the conduit. The use of tool 1 on a non-damaged pipe is anticipated in piping/conduit systems that do not have typical shut down or flow control devices or that may have such devices but which are not working properly or are not readily accessible.

The tool is designed to be portable and easy to use by a user of any skill level. For example, the tool may be advantageously used by contractors working on building sites where accidental damage to pipes may occur. Upon operation of the tool, the contractor would be able to easily and quickly seal off a pipe that has cracked or burst to prevent damage to the surrounding structure. Additionally, the tool may be used in the home in the event a pipe in any area of the home breaks. The tool will apply enough force to the walls of the pipe to crimp the section upstream from the break or crack to allow the user enough time to locate and activate any shut-off mechanism. Crimping the pipe upstream from the damaged section prevents the flow of any liquid or gas from reaching the damaged section of the pipe and flowing out therefrom. Alternatively, the tool may be used as the shut-off mechanism when there is no mechanism present.

FIG. 1 is a front view of the tool 1 for use in crimping a conduit that has either a liquid or a gas flowing therethrough. FIG. 1 shows the tool in the closed position after it has crimped a conduit. Shown herein, is the crimping section 17 and the handle section 19 and the conduit 100. The handle section 19 is comprised of a first handle member 60 and a second handle member 61 wherein, separate corresponding pieces of handle members 60 and 61 make up the mid section 18 and gripping section 62 of the tool. The crimping section 17, mid section 18 and gripping section 62 are distinct and separate sections that form the tool 1. Each section of the tool may be manufactured individually and then fit together via the connection methods described herein. The crimping section 17 and the gripping section 62 are connected to opposing ends of the middle section 18 in the manner discussed below.

The crimping section 17 includes a first crimping member 2, a second crimping member 3 and a lock bar 8. Crimping members 2 and 3 have crimping edges 20 and 21, respectively. The crimping edges 20 and 21 are substantially flattened or blunt and have a width or thickness sufficient to prevent the conduit from being cut or severed when a conduit is crimped therebetween. Lock bar 8 is connected to the first crimping member 2, via a first clevis pin 25, and to the second crimping member 3, via a second clevis pin 26. The connection of lock bar 8 to crimping members 2 and 3 results in the first crimping member 2 being connected to the second crimping member 3 at the geared area 24. The actual geared area 24 is not shown but will be further described in the discussion of FIG. 2. While a clevis pin assembly is described for use in connecting lock bar 8 to crimping members 2 and 3, any known connection mechanism that connects the lock bar 8 to crimping members 2 and 3 while allowing crimping members 2 and 3 to pivot about the geared area 24, may be used. When the tool 1 is in a closed or engaged position, as in FIG. 1, edges 20 and 21 are positioned facing one another and are in parallel alignment with gears 24.

Crimping member 2 is connected to the first leg 4 of the middle section 18 via clevis pin hinge 10. Crimping member 3 is connected to the second leg 5 of the middle section 18 via connection hinge 12.

Additionally, as will be discussed hereinafter with respect to FIGS. 11-14, the crimping members may be formed in alternate configurations. For example, depending on the thickness, diameter and material of the walls of the conduit to be crimped, the crimping edges 20 and 21 may be configured to produce a male extension on one crimping edge and female receiver on the second crimping edge in both the long axis and short axis of the face of the crimping edges, so that the conduit walls are crimped into a U-shaped configuration. The U-shaped formation will provide additional obstruction/crimping to the conduit walls.

The mid section 18 includes a first leg 4 and a second leg 5 which share a common mating aperture 49. First lock bar 8 and a second lock bar 9 also share a common mating aperture 49 and are part of a locking mechanism that will be further described in the discussion of FIG. 3. A clevis pin hinge 11 extends through the mating aperture 49 to form a connection about which the first and second legs 4 and 5 pivot. The clevis pin hinge 11 may include a clevis pin assembly or any other mechanism that allows a pivotal connection to be formed between the first and second legs 4 and 5 and allows relative movement of locking bars 8 and 9.

The first leg 4 is connected to the gripping member 29 of the gripping section 62 via clevis pin assemblies 13 and 14. The second leg 5 is connected to the gripping member 30 of the gripping section 62 via clevis pin assemblies 15 and 16. The connection of gripping members 29 and 30 to legs 4 and 5 of the mid section 18 by clevis pin assemblies allows gripping members 29 and 30 each to be selectively removed from the mid section 18 as needed.

The gripping section 62 is comprised of a first gripping member 29 and a second gripping member 30. The gripping member 29 is comprised of a first gripping handle 22 and a first handle connection piece 6. A clevis pin assembly 27 connects first gripping handle member 22 to first handle connection piece 6. The clevis pin assemblies are described for example only and any connector able to releaseably connect the gripping handle 22 to the handle connection piece 6 may be used. The second gripping member 30 is comprised of a second gripping handle 23 and a second handle connection piece 7. A clevis pin assembly 28 connects second gripping handle 23 to second handle connection piece 7.

The gripping section 62, crimping section 17 and the middle section 18 each have their own locking mechanisms 35, 45 and, 39 respectively. Each of the three locking mechanisms may be engaged when the crimping sections 2 and 3 are closed and the conduit is crimped.

The first method to selectively prevent crimping edges 20 and 21 from opening is to engage locking mechanism 35 using swing plate 37 and wing nut and bolt assemblies 36 and 38. The swing plate 37 includes a first end pivotally secured to the gripping member 22 by wing nut and bolt assembly 36. A second end of the swing plate 37, positioned on a side opposite the first end, includes a notch for being selectively received by wing nut and bolt assembly 38. When the crimping sections 20 and 21 are closed and the conduit is crimped, the notched end of the swing plate 37 is placed around the wing nut and bolt assembly 38. The wing nuts at 36 and 38 are then tightened to secure the swing plate in place. Note that the first end of swing plate 37 is typically loosely attached to griping member 22 via the wing nut 36, allowing the swing plate 37 to pivot about the wing nut and bolt assembly 36, and is only tightened when the notch at the second end receives wing nut and bolt assembly 38. This enables the swing plate 37 to remain moveably attached to handle section 22 which allows for an easier positioning of the notch to be secured by the wing nut and bolt assembly 38. The notch at the second end may be positioned on an edge thereof which, when the swing plate 37 is pivoted in a clockwise direction, allows for the notch to be positioned over the bolt of the wing nut assembly 38 thereby preventing any further pivoting thereof. The wing nut may then be rotated, thereby bracing the second end of the swing plate between a washer and surface of the gripping member 23. When secured, the swing plate 37 prevents the first and second legs 4 and 5 of the mid section 18 from pivoting about pivot 11 and maintains the crimping edges 20 and 21 in a closed position. Additionally, there may be multiple swing plates of slightly increasing size, pivotally secured to gripping member 22 at the wing nut and bolt assembly 36. The progression of slightly longer swing plates will allow the user to select the swing plate that best matches the distance between the gripping members 22 and 23 when the tool has crimped a conduit, as this distance may vary slightly depending on the thickness of the walls of the conduit being crimped. The wing nut and plate assemblies are described for example only. Any connector able to rotatably connect the swing plate 37 to first gripping handle 22 may be used. And connector that may releasably receive swing plate 37 on gripping handle 23 may be used. Any plate, rod or connector that can be used to secure the gripping members together may be used.

The second method to selectively prevent crimping edges 20 and 21 from opening is to engage the j-shaped lock bar assembly 45. The third method to selectively prevent crimping edges 20 and 21 from opening is to engage the double lock bar assembly 39 which includes lock bar 8, lock bar 9 and threaded bolt 44. The second and third methods of preventing crimping edges 20 and 21 from opening will be further described in description of FIGS. 2 and 3, respectively.

During operation whereby the tool is moved from the open position to the closed position, in an effort to crimp the conduit, the user grips and applies force to the gripping members 29 and 30 so they move towards each other causing legs 4 and 5 of the mid section to pivot about hinge 11, which applies force to crimping members 2 and 3 at hinge connections 10 and 12, respectively, which in turn causes crimping members 2 and 3 to pivot about geared section 24. The geared section 24, working with the lock bar 8, transfers and reverses the force received by crimping members 2 and 3 at hinges 10 and 12, to the crimping edges 20 and 21 directing them towards each other. The forces transferred to the crimping edges 20 and 21 are applied to the conduit 100 to force the walls thereof in on themselves and close the opening of the conduit thereby preventing any flow of liquid or gas therethrough. After the conduit is crimped the locking mechanisms may be engaged.

Figure 2B:
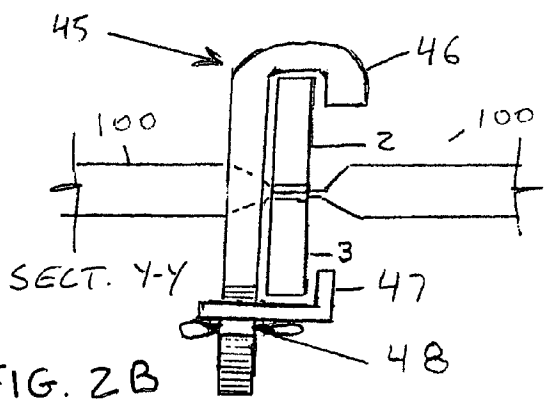

FIG. 2 is a front view of the crimping section 17 of the tool 1 taken with illustrative removal of the front side of the lock bar 8 and 9. Lock bar 8 is further shown in FIG. 5 and should be consulted when references to illustrative views, plate extensions and channels of lock bar 8 are mentioned in this section. The illustrative removal of the front side of lock bar 8 at the plate extension 75 exposes the geared section 24 for discussion purposes. The dotted line in FIG. 2 illustrates the back side of plate extension 76 of lock bar 8 which is blocked from view by crimping members 2 and 3. The illustrative removal of the front sides of the lock bar 8 and 9 in the area of the oblong channel 40 in lock bar 8 and the channel 42 in lock bar 9 will assist in the review of the third locking mechanism 39 which is described in the discussion of FIG. 3. Also shown in FIG. 2B is an exploded view of the second locking mechanism assembly 45.

The first crimping member 2 and the second crimping member 3 of the crimping section 17 are secured to one another along the geared section 24 via the plate extensions 75 and 76 of locking bar 8. The first crimping member 2 includes an aperture 50 extending therethrough. The second crimping member 3 includes aperture 51 extending therethrough. Lock bar 8 includes a front and back plate extension 75 and 76, respectively, with channels 56 and 57 extending therethrough both plate extensions 75 and 76. The distance between the center line of channels 56 and 57 is set at the same distance as the distance between center lines of apertures 50 and 51 when crimping members 2 and 3 are mated together at the geared area 24. The channels 56 and 57 are aligned with the apertures 50 and 51 of crimping members 2 and 3, respectively, and receive the clevis pin hinges 25 and 26, respectively, therethrough. The clevis pin 25 is inserted into channel 56 of the front side of plate extension 75, and extends through aperture 50 of crimping member 2, and through the section of channel 25 in the back plate extension 76. The clevis pin 26 is inserted into channel 57 of the front side of plate extension 75, and extends through aperture 51 of crimping member 3, and through the section of channel 57 in the back plate extension 76. The clevis pin hinges 25 and 26 secure lock bar 8 to crimping members 2 and 3 and secure crimping members 2 and 3 to each other at the geared area 24. The clevis pin hinges 25 and 26 may be a clevis pin assembly or a nut and bolt assembly or any other hinge mechanism able to connect lock bar 8 to crimping members 2 and 3 while allowing crimping members 2 and 3 to pivot about the geared area 24.

The geared area 24 is formed from arc-shaped sections having a plurality of teeth extending outward from each of the first crimping member 2 and the second crimping member 3. The teeth are etched in the arc-shaped surface to form the gears 24. The first crimping member 2 and the second crimping member 3 are positioned facing one another, thus allowing the teeth to mate and further allowing the first and second crimping members 2 and 3 to pivot. During operation, the first crimping member 2 and the second crimping member 3 pivot about the geared area 24 to create a space between the first and second crimping edges 20 and 21. This pivot is facilitated by the shape of each respective first crimping member 2 and the second crimping member 3.

The first crimping member 2 and the second crimping member 3 have a first width at the point of connection to the first and second legs 4 and 5 (FIG. 1), respectively. The width of the first crimping member 2 and the second crimping member 3 gradually increase in direction opposite the connection point to have a second width, greater than the first width, beginning at the base of the crimping edges 20 and 21.

The gradual increase in width between the first and second widths enables the crimping members to pivot about the geared section 24 and create an opening between the crimping edges 20 and 21.

As shown in FIG. 2B, the second method to selectively prevent crimping edges 20 and 21 from opening after they have crimped a conduit is to engage the j-shaped lock assembly 45 which includes j-shaped lock bar 46 with one threaded end, bent plate 47 with one aperture and wing nut assembly 48. When the crimping sections 2 and 3 are closed and the conduit is crimped, the j-shaped lock bar 46 is placed over the crimping members 2 and 3 so that the hooked end of the j-shaped lock bar 46 is received in the notch in crimping member 2. The aperture in bent plate 47 is then received by the threaded end of j-shaped lock bar 46 so that the bent plate 47 is placed into the notch in crimping member 3. The wing nut 48 is tightened onto the threaded end of j-bar 46, locking j-bar 46 around the crimping section and preventing the crimping edges 20 and 21 from opening. While the use of a j-shaped lock bar, bent plate and wing nut are described for use in locking together crimping pieces 2 and 3, any known mechanical connection mechanism that allows crimping members 2 and 3 to be directly secured in a closed position may be used.

Figure 3:
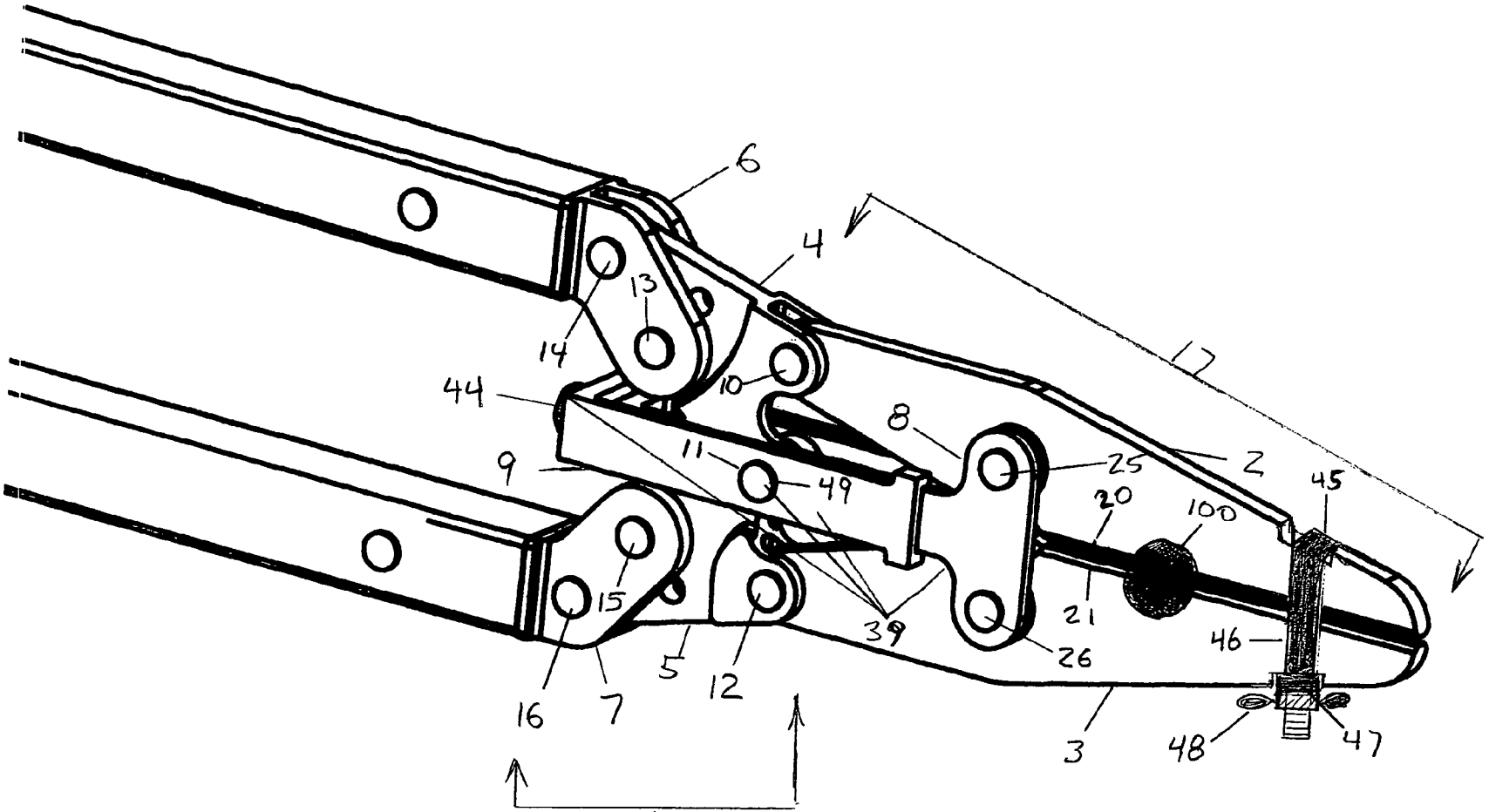
FIG. 3 is an exploded isometric front view of the crimping section and the mid section of the Emergency Flow Stoppage Tool shown in FIG. 1 according to invention principles.

FIG. 3 is an exploded isometric view of the crimping section 17 and the mid section 18 of the tool 1. Shown herein is (i) the connection of crimping section 17 to mid section 18, (ii) the shared connection that connects legs 4 and 5 of the mid section 18 to each other as well as to lock bars 8 and 9 and (iii) the third locking mechanism assembly 39.

Figure 4:
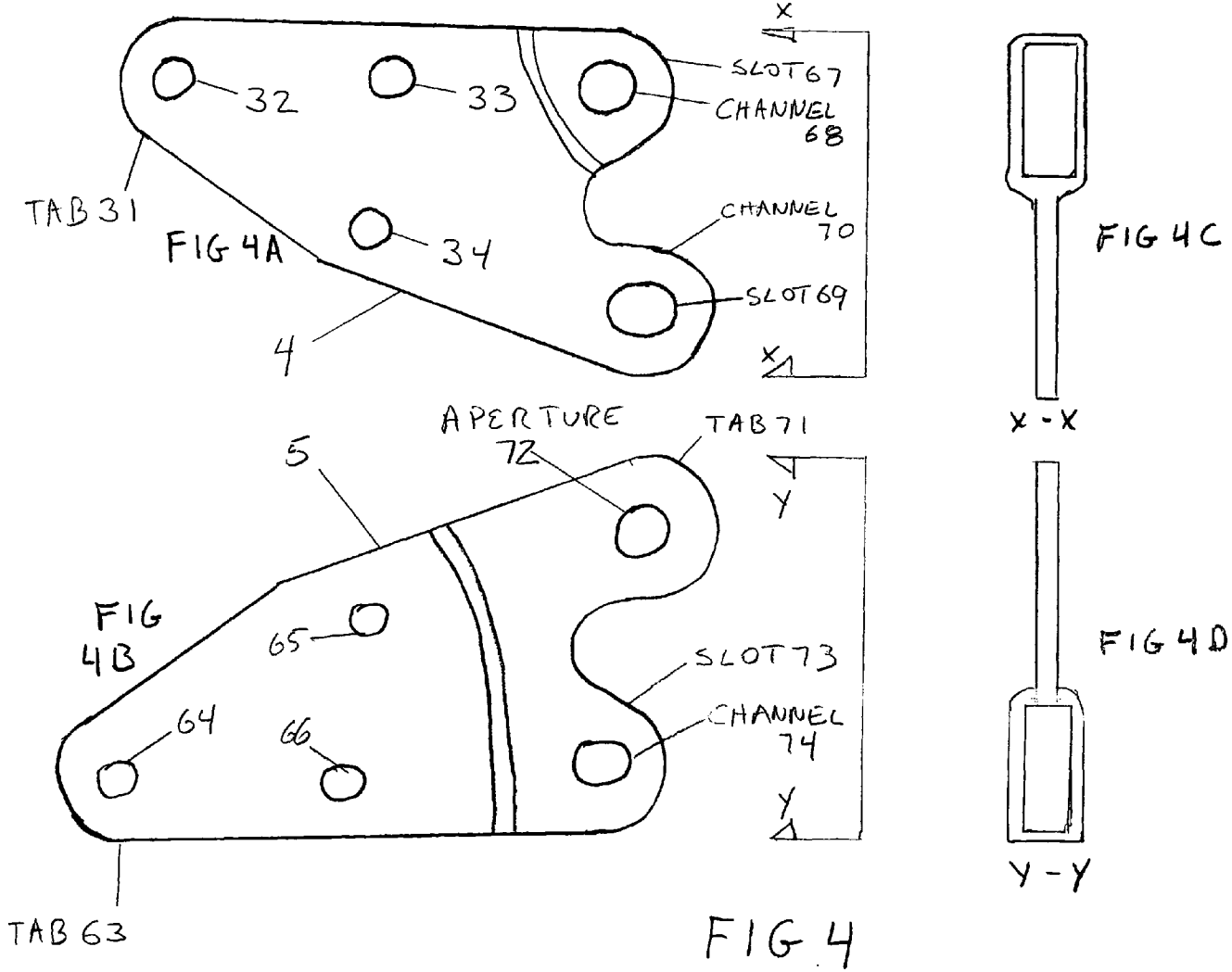
FIG. 4 is a front and side view of the two legs of the mid section of the Emergency Flow Stoppage Tool according to invention principles.

Please note the following: FIG. 2 further shows the connection points of crimping members 2 and 3 of the crimping section 18 and the connection of lock bars 8 and 9 with the illustrative removal of the front sides of the lock bar 8 and 9. FIG. 4 further shows the connection points of legs 4 and 5 of the mid section 17. FIGS. 2 and 4 should be consulted when slots, channels, tabs, apertures and the shared connection of legs 4, leg 5 lock bar 8 and lock bar 9 are referenced in this section.

As shown crimping members 2 and 3 are connected to legs 4 and 5 of the mid section, respectively. The first crimping member 2 includes a tab 52 extending at an end thereof that is connected to the first leg 4 of the mid section 18. The tab 52 includes an aperture 53 extending transversely through tab 52. The first leg 4 includes a slot 67 extending partially therein and a channel 68 extending transversely therethrough slot 67. The channel 68 bisects the slot 67 and extends through the first leg 4. The tab 52 is received within the slot 67 such that the aperture 53 is aligned with the channel 68 and the first crimping member 2 is connected to the first leg 4 via the clevis pin hinge 10. The connection hinge 10 may include a clevis pin and/or nut and bolt assembly or any other hinge mechanism that is able to pivotally connect the first crimping member 2 to the first leg 4. The clevis pin is inserted into the channel 68 on a first side of the first leg 4 and extends through the channel 68 and the aperture 53 of crimping member 2.

Crimping member 3 is connected to leg 5 of the mid section, in a manner similar to the connection of crimping member 2 to leg 4 as shown above, using aperture 55 in tab 54 of crimping member 3, channel 74 in slot 73 of leg 5 and clevis pin hinge 12.

Figure 5:
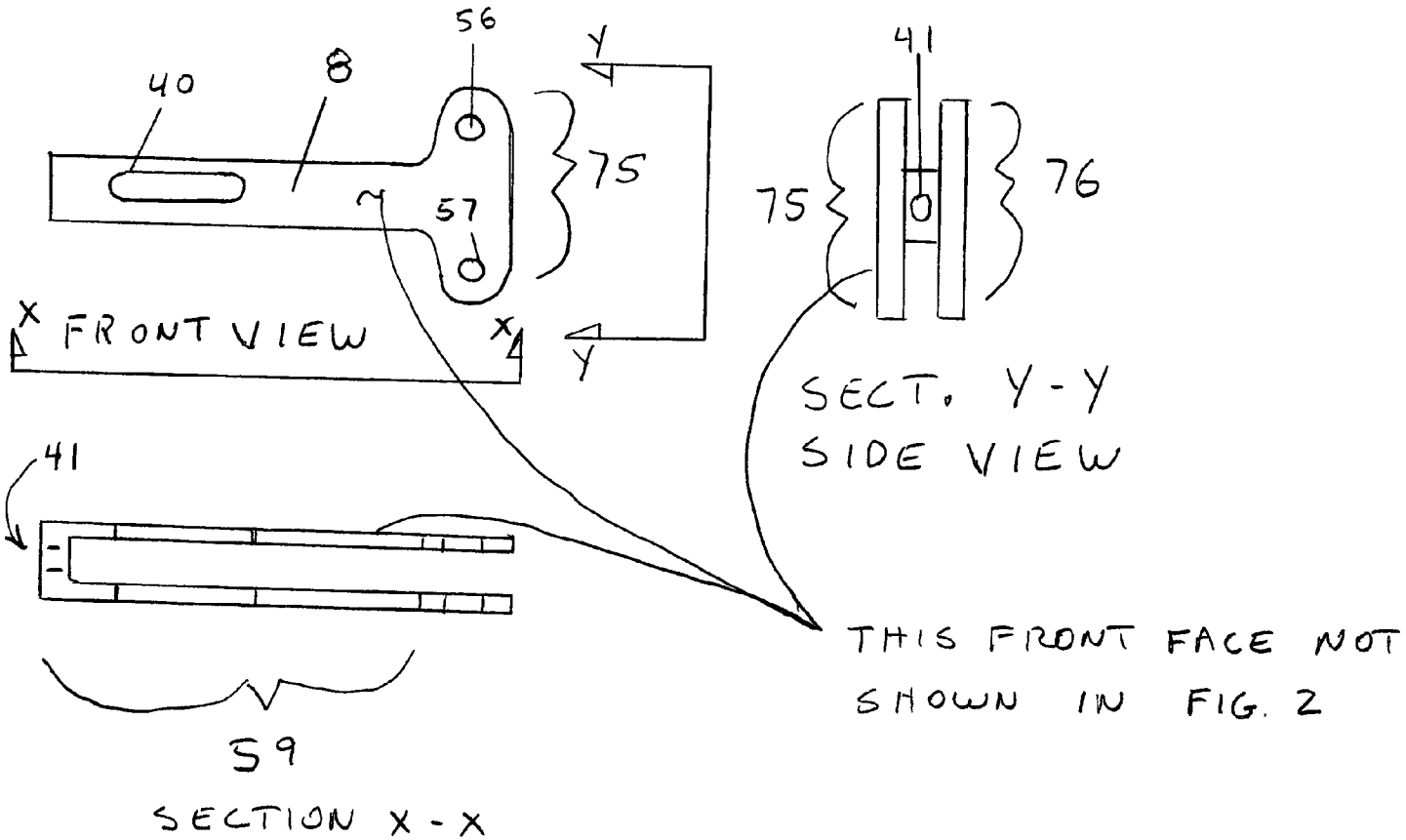
FIG. 5 is a front, side and bottom view of the first lock bar of the Emergency Flow Stoppage Tool according to invention principles.
Figure 6:
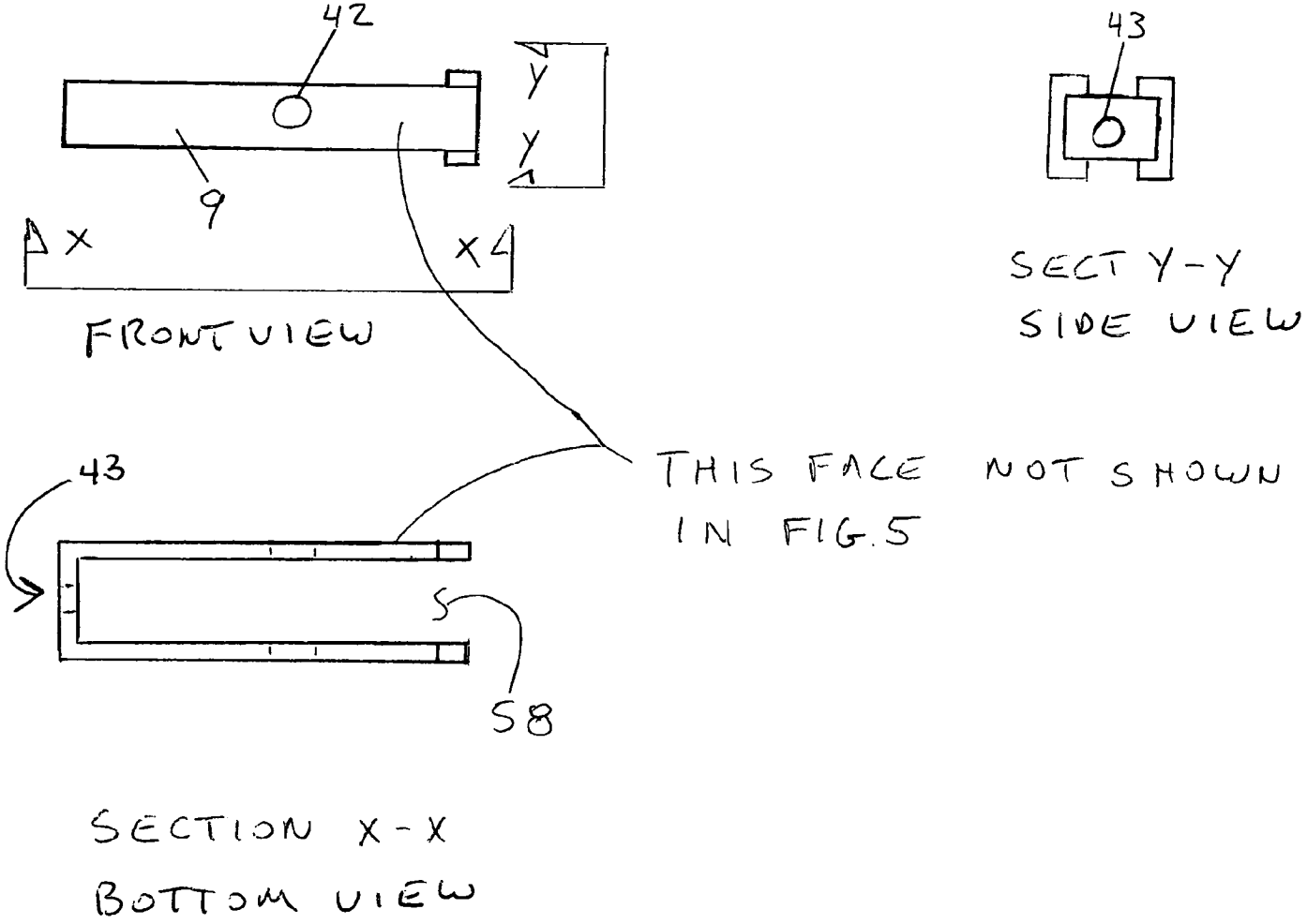
FIG. 6 is a front, side and bottom view of the second lock bar of the Emergency Flow Stoppage Tool according to invention principles.

Legs 4 and 5 of mid section 18 and lock bars 8 & 9 share a common mating aperture 49 that receives clevis pin assembly 11. The common mating aperture 49 connects legs 4 and 5 of mid section 18, to each other and to lock bar 8 and 9 as described below. The connection points of legs 4 and 5 of mid section 18 are further shown in FIG. 4. Lock bars 8 and 9 are further detailed in FIGS. 5 and 6 respectively. FIGS. 4, 5 & 6 should be consulted when slots, channels, tabs, apertures, male connectors and female receptors are referenced in this section. Lock bar 9 includes a female receptor 58. Lock bar 8 includes a corresponding male connector 59. Lock bar 9 has a channel 42 extending therethrough the female receptor 58. Lock bar 8 includes an oblong shaped channel 40 extending therethrough the male connector 59. Leg 4 includes a slot 69 extending partially therein and a channel 70 extending therethrough slot 69. Leg 5 includes a tab 71 and an aperture 72 extending through tab 71. The male connector 59 of lock bar 8 is received by the female receptor 58 of lock bar 9 to allow channel 42 of lock bar 9 to align in slotted channel 40 of lock bar 8. Legs 4 and 5 are aligned so that slot 69 in leg 4 accepts tab 71 in leg 5 so that channel 70 in slot 69 is aligned with aperture 72 of tab 71 and so that channel 70 and aperture 72 are also aligned with channel 42 of lock bar 9. The clevis pin 11 is inserted into the channel 42 on a first side of the lock bar 9 and extends through channel 42, slotted channel 40 on lock bar 8, channel 70 of first leg 4, and aperture 72 of second leg 5, pivotally connecting legs 4 and 5 to each other, lock bars 8 and 9 to each other and legs 4 and 5 to lock bars 8 and 9.

The connection assembly of legs 4 and 5 to each other and to lock bars 8 and 9 is also used in the third locking mechanism, double lock bar assembly 39, to selectively prevent crimping edges 20 and 21 from opening after they have crimped a piece of conduit. Lock bars 8 and 9 are further shown in FIGS. 5 and 6, respectively and should be consulted when slots, channels, female receptors and male connectors are referenced in this section. Double lock bar assembly 39 includes lock bar 8, lock bar 9, clevis pin assembly 11 and threaded bolt 44. As described above, lock bar 8 is attached to the crimping edges 2 and 3 at clevis pin connection 25 and 26. Male connector 59, of lock bar 8, is received by the female receptor 58, of lock bar 9, to allow channel 42 of lock bar 9 to align in the oblong shaped channel 40 of lock bar 8. Clevis pin assembly 11 is accepted in channel 42, of lock bar 9, and both channel 42 and clevis pin 11 are accepted in the oblong channel 40 of lock bar 8 in a manner that allows both channel 42 and clevis pin 11 lateral movement within oblong channel 40. When the crimping sections 2 and 3 are closed, and the conduit is crimped, the threaded bolt 44 is manually pushed through aperture 43 of lock bar 9 until it touches and aligns with the threaded opening 41 in the bottom of lock bar 8. Once contact between bolt 44 and aperture 41 is made, bolt 44 is manually screwed into the threaded opening 41 in lock bar 8 until the head of bolt 44 tightly connects to the bottom of lock bar 9 thus locking lock bars 8 and 9 together. As lock bar 8 is rigidly attached to the Tool 1 at clevis pin connections 25 and 26, and lock bar 8 is locked to lock bar 9, channel 42 of lock bar 9 is locked in place. As channel 42 is locked in place, the clevis pin 11 in channel 42 is locked in place and movement of clevis pin 11 is prevented. As movement of clevis pin 11 is prevented, the movement of hinged sections at clevis pins 10 and 12, which are dependent on movement of clevis pin 11, is prevented. As the movement of hinged sections at clevis pins 10 and 12 are prevented, movement of crimping members 2 and 3, which are dependent on movement of clevis pins 10 and 12, is prevented and crimping members 2 and 3 remain in a closed position.

An alternate method to secure lock bar 8 to lock bar 9 may include the use of a fully threaded bolt which would be screwed though apertures 41 and 43 with both apertures 41 and 43 being threaded to accept threaded bolt 44. In addition, the head of bolt 44 may be configured with a shape for manual rotation of the bolt and/or with adaptations to allow socket and screwdriver usage to facilitate rotation of the bolt. While the use of a threaded bolt with varying configurations for rotation and threaded and non-threaded apertures are described for use in connecting lock bar 8 and lock bar 9 to each other, any known connection mechanism that allows lock bar 8 to be releaseably connected to lock bar 9 may be used.

FIG. 4 is a front and side view of the two legs 4 and 5 of the mid section 18 of tool 1 as discussed above and below.

FIG. 5 is a front, side and bottom view of the first lock bar 8 of tool 1 as discussed above.

FIG. 6 is a front, side and bottom view of the second lock bar 9 of tool 1 as discussed above.

Figure 7:
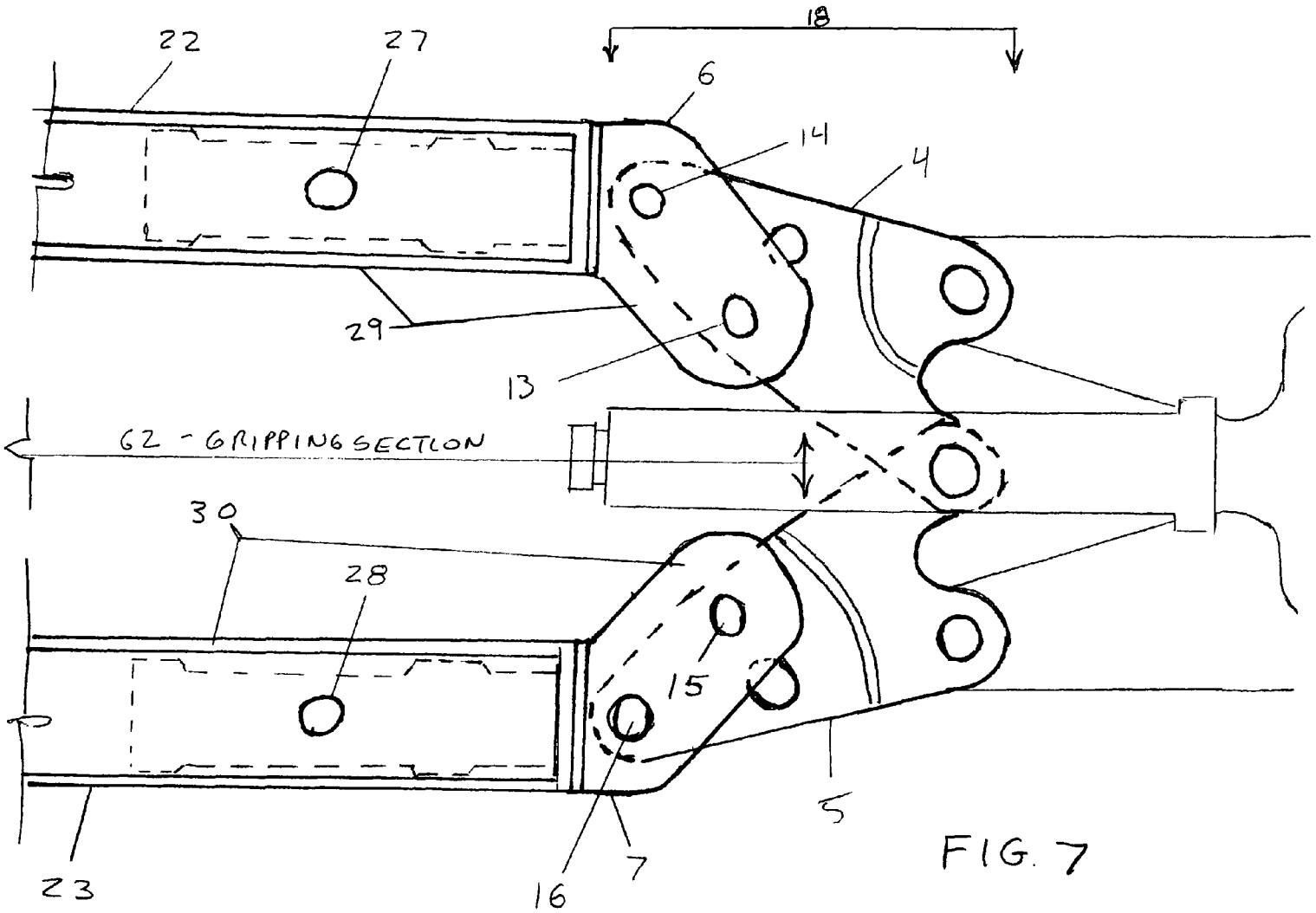
FIG. 7 is an exploded front view of the mid section and the handle connection pieces of the Emergency Flow Stoppage Tool according to invention principles.
Figure 8:
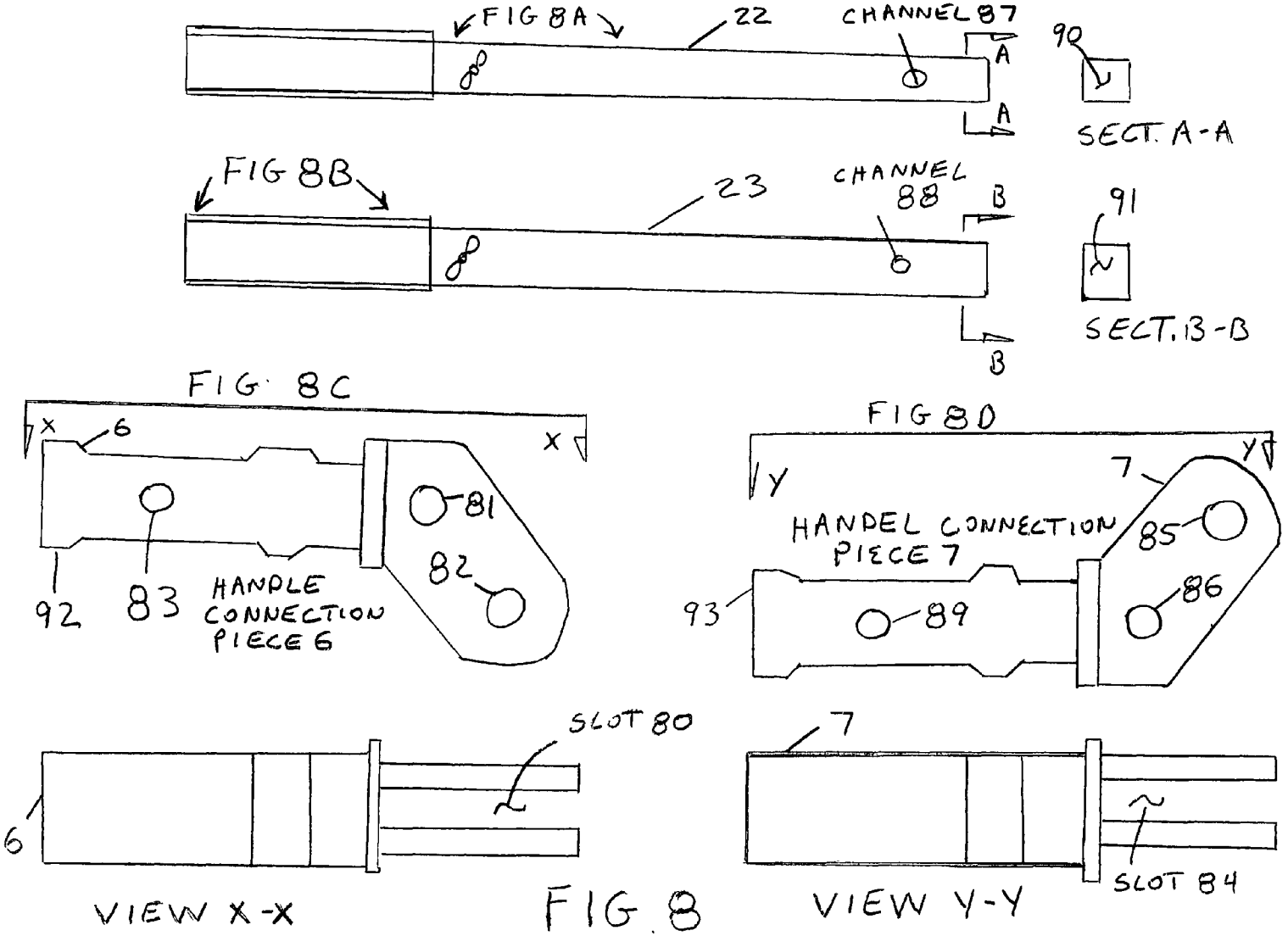
FIG. 8 is a front view of the gripping members and exploded front and top views of the handle connection pieces of the Emergency Flow Stoppage Tool according to invention principles.

FIG. 7 is a front view of the first leg 4 and second leg 5 of mid section 18 of tool 1 and their connections to the handle connection pieces 6 and 7 of the gripping members 29 and 30, respectively. Also shown is the connection of handle connection pieces 6 and 7 to gripping handles 22 and 23 to form gripping members 29 and 30 respectively. FIG. 4 further details the connection points of legs 4 and 5 of the mid section 18. FIGS. 8 including, 8A, 8B, 8C and 8D further detail the connection points of gripping handle 22, gripping handle 23, handle connection piece 6 and handle connection piece 7, respectively. Please note, in FIG. 8 gripping handles 22 and 23 are shown in smaller scale than handle connection pieces 6 and 7. FIGS. 4 and 8 should be consulted when slots, channels, tabs, apertures, male connectors and female receptors are referenced in this section.

Leg 4, of the middle section 18, includes a tab 31 extending at an end thereof that is connected to the handle connection piece 6 of the gripping member 29. The tab 31 includes an aperture 32 extending transversely through tab 31. The handle connection piece 6 includes a slot 80 extending partially therein and a channel 81 extending transversely therethrough slot 80. The tab 31, of leg 4, is received within the slot 80 such that the aperture 32 is aligned with the channel 81, and the first leg 4 of the middle section 18 is initially pivotally connected to the handle connection piece 6 via the connection clevis pin connection 14. Additionally, the first leg 4 includes two additional apertures, 33 and 34, extending therethrough. The handle connection piece 6 includes a second channel 82 extending therethrough slot 80. The first leg 4 is further positioned within the slot 80 such that aperture 33 or 34 is aligned with channel 82, of the handle connection piece 6, connecting first leg 4 to the handle connection piece 6, via clevis pin connection 13, in a fixed position. The alignment of aperture 33 or 34 to channel 82 will allow the user to attach the crimping member in either of two selective positions.

The mid section 18 includes a second leg 5 connected to the handle connection piece 7 of gripping member 30, which are connected in a similar manner described above for the connection of the first leg 4 to handle connection piece 6 of gripping member 29, using channels 85 and 86 in slot 84 of handle connection piece 7 and tab 63, apertures 64, 65 and 66 of leg 5.

The user may connect the gripping members 29 and 30 in either of the two selective positions based upon on needed leverage, diameter of the conduit being crimped and clearance needed for the operation of the tool. It is also anticipated that the user may perform a first initial crimp with the gripping members in a first position and then re-crimp the conduit fully with the gripping members in a second position, again, as required by needed leverage, diameter of the conduit being crimped and clearance needed for the operation of the tool.

The connection of the handle connection members 6 and 7 to the mid section 18 via clevis pin assemblies 13, 14, 15 and 16 allow the gripping members 29 and 30 to each be selectively removed from the middle section 18 as needed. The clevis pin assemblies are described for example only and any connectors able to releasably connect the handle gripping members 29 and 30 to the mid section may be used.

Gripping member 29 consists of gripping handle 22 and handle connection piece 6. Gripping handle 22 includes a square female receptor 90 with a channel 87 therethrough. The handle connection piece 6 includes a square male extension 92 with a channel 83 therethrough. The female receptor 90 of gripping handle 22 is positioned to accept the male connector 92 of handle connection piece 6 so that channel 87 of gripping handle 22 aligns with channel 83 of handle connection piece 6. The clevis pin 27 is inserted into the channel 87 on a first side of gripping handle 22 and extends through channel 87 and the channel 83 of handle connection piece 6 connecting gripping handle 22 to handle connection piece 6 creating gripping member 29.

A second gripping member 30 consists of gripping handle 23 connected to handle connection piece 7, which are connected in a similar manner described above for the connection of gripping handle 22 to handle connection piece 6, using female receptor 91 and channel 88 in gripping handle 23, channel 89 in male connector 93 in handle connection piece 7, and clevis pin assembly 28.

FIG. 8 is a front view of the gripping handles 22 and 23 and an exploded front and top view of handle connection pieces 6 and 7 of tool 1 as discussed above.

Figure 9:
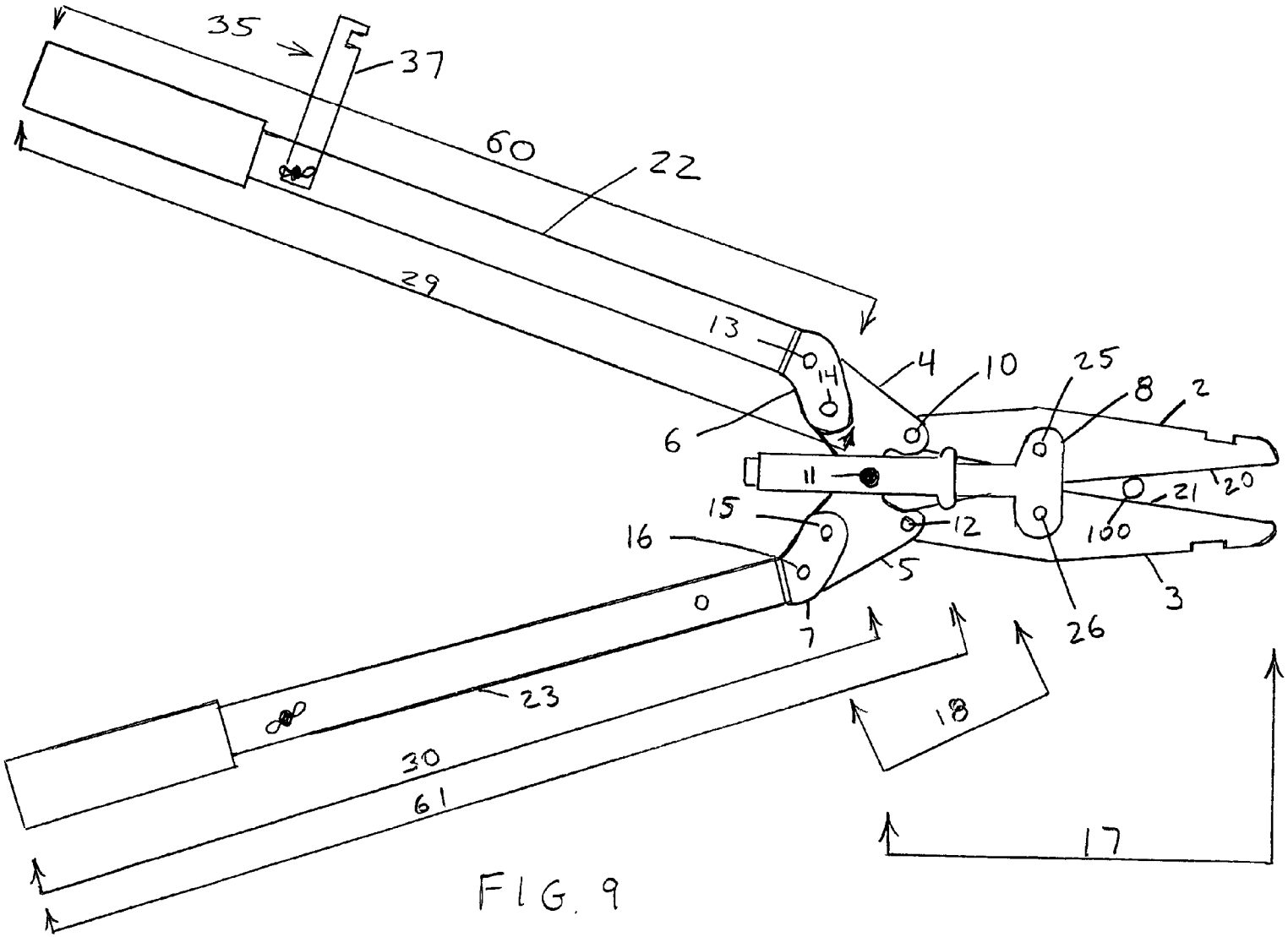
FIG. 9 is a front view of the Emergency Flow Stoppage Tool in an open position according to invention principles.

FIG. 9 is a front view of tool 1 in an open or disengaged position. The gripping members 29 and 30 are moved in a direction away from one another causing legs 4 and 5 of the mid section to pivot about hinge 11. This forces hinge 11 to move towards the gripping area of the tool and forces hinges 10 and 12 to pivot around hinge 11 and towards each other. As hinges 10 and 12 move towards each other, the first and second crimping members, at their connection to hinges 10 and 12 respectively, move towards each other forcing crimping members 2 and 3 to pivot about the geared section 24. The geared section 24, working with the lock bar 8, transfers and reverses the force received on crimping members 2 and 3, at hinges 10 and 12, to the crimping edges 20 and 21 directing crimping edges 20 and 21 apart so they may receive a conduit therebetween.

When the tool 1 is moved from the open or disengaged position as shown herein, to the closed position as shown in FIG. 1, force is applied to the gripping members 29 and 30 so they move towards each other causing legs 4 and 5 of the mid section to pivot about hinge 11. This forces hinge 11 to move towards the crimping section and in between hinges 10 and 12, forcing hinges 10 and 12 to pivot around hinge 11 and away from each other. As hinges 10 and 12 move away from each other, the first and second crimping members, at their connection to hinges 10 and 12 respectively, are forced apart thus forcing crimping members 2 and 3 to pivot about the geared section 24. The geared section 24, working with the lock bar 8, transfers and reverses the force received by crimping members 2 and 3 at hinges 10 and 12 to the crimping edges 20 and 21 directing crimping edges 20 and 21 towards each other. The forces transferred to the crimping edges 20 and 21 are applied to the conduit 100 to force the walls thereof in on themselves and close the opening of the conduit thereby preventing any flow of liquid or gas therethrough. The user may then engage any combination of the three locking mechanisms.

The user may also remove the gripping members 29 and 30 from the mid section 18 by disengaging the two handle connection pieces 6 and 7 from first and second legs 4 and 5, respectively. The disengagement of handle connection piece 6 may be performed by the removal of clevis pin assemblies 13 and 14, which releases the handle connection piece 6 from the first leg 4. Similarly the disengagement of handle connection piece 7 may be performed by disengaging clevis pin assemblies 15 and 16, which releases the handle connection piece 7 from the second leg 5. The disconnection of gripping members 29 and 30 should be performed after securing crimping edges 20 and 21 by the second and/or third locking mechanism 45 and 39 described above, and after disengagement of the first locking mechanism 35 if it has been engaged. The locking mechanism 35 may be disengaged by loosening wing nut assemblies 36 and 38 and releasing and disengaging the swing plate 37. The removal of the gripping members as described above will reduce the torque effect that the secured tool 1 has on the conduit being crimped.

Figure 10:
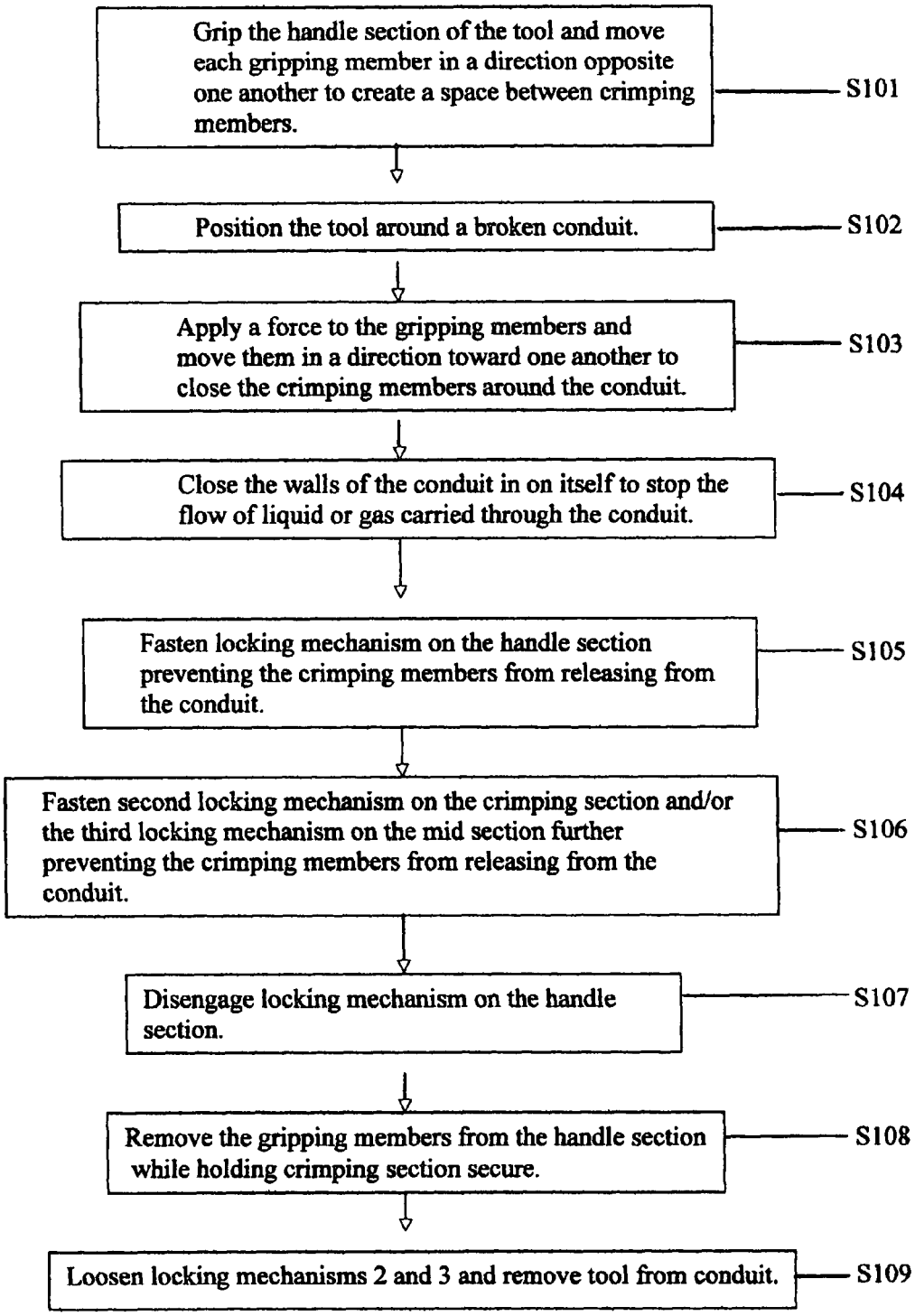
FIG. 10 is a flow diagram detailing the operation of the Emergency Flow Stoppage Tool according to invention principles.

FIG. 10 is a flow diagram detailing the operation of the Emergency Flow Stoppage Tool, according to invention principles, that will now be used to discuss the operation of the tool 1 with respect to FIG. 10. When an undesired flow of liquid or other substance is flowing through a malleable conduit that is damaged, an emergent need arises to reduce or eliminate the flow of the liquid therethrough. In step S101, the handle section is gripped by a user and each respective gripping member is moved in a direction opposite one another. This causes the crimping members to pivot about their respective pivot points to create an opening between the crimping edges thereof. The user may then position the tool around a conduit that has been damaged as in step S102. The tool is positioned upstream from the damaged section of the conduit. Once positioned, the user applies a force to the gripping members to move them in a direction toward one another causing the crimping members to pivot and crimp the conduit, as in step S103. Additionally, a user may be required to repeat steps S102 and S103 and/or remove and reinstall the gripping members to gain better access or leverage, and repeat steps S101, S102 and S103 depending on the size of the conduit being crimped, the nature of the material that was used to make the conduit and the accessibility of the damaged conduit. Upon the conduit being crimped, the walls of the conduit close in on themselves to stop the flow of liquid or gas therethrough as is step S104. To ensure that the conduit remains crimped and the flow of the liquid remains halted, step S105 states that the first locking mechanism be releaseably engaged to secure the handles of the tools together which will prevent the tool from being released from the conduit. The locking mechanism may be a swing plate that is secured to one of the gripping members of the handle section and is manually closed by positioning a hooked or notched end around a threaded pin on the second gripping member of the handle section and rotating wing nut assemblies on the first and second gripping member to secure the swing plate. Additionally, to ensure that the conduit remains crimped and the flow of the liquid remains halted, step S106 states that a second and/or third locking mechanism be engaged to releasably secure the crimping section of the tool and prevent the tool from being released from the conduit. For example, the second locking mechanism may be engaged be placing a J-shaped lock bar over the crimping section and securing with the bent plate and wing nut assembly, which will lock the two crimping heads together. The third locking mechanism may be engaged by inserting a threaded bolt though a locking bar that controls the location of the hinge point between the handle members. The threaded bolt is then screwed into another locking bar that is rigidly attached to the tool thus securing the two locking bars together and preventing movement of the hinge point of the handle members which prevents movement of the crimping heads. These manners of locking the crimping heads together are described for purpose of example only and any mechanisms or series or mechanisms that secure the crimping head together may be implemented. If engaged, a user may disengage the swing bar locking mechanism on the handle section, as shown in S107, by loosening the wing nuts on both sides of the swing plate and then applying a force to the gripping members, to move them in a direction toward one another, allowing the user to then rotate the notched end of the swing plate away from the second gripping member. Once the swing plate is disengaged, the user may elect to remove the individual gripping members from the tool to reduce the torque effect on the conduit, as in step S108, by removing the clevis pin assemblies attaching the gripping members to the mid section and removing the gripping members from the mid section. The user should also hold and secure the tool while the gripping members are removed from the mid section to avoid further damaging the conduit. After the source of the liquid or other material in the pipe is shut down, via a valve or other mechanism, the tool may be removed from the conduit as in step S109. If the second locking mechanism, j-bar assembly 45, has been engaged, the user should loosen the wing nut and remove the j-shaped lock bar. If the third locking mechanism, double lock bar assembly 39, has been engaged, the user should loosen the threaded bolt. The user should then reattach the gripping members and apply a force to the gripping members to move them in a direction away from one another causing the crimping members to release the conduit and allow the user to remove the tool from the conduit.

Figure 13:
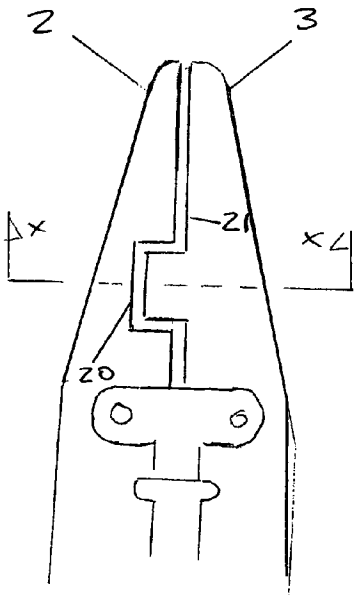
FIGS. 11-13 are front views of the crimping section of the Emergency Flow Stoppage Tool according to invention principles showing additional crimping member configurations.
Figure 12:
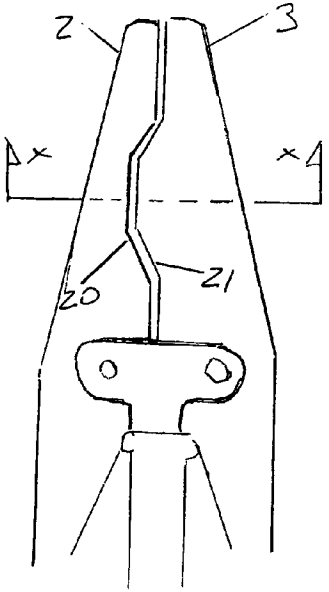
Figure 11:
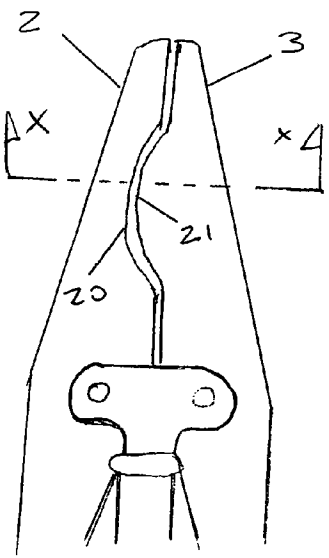

FIGS. 11-13 are front views of the crimping section showing alternative shapes for the crimping members 2 and 3, which form the crimping section 17 of the tool 1. FIGS. 11, 12 and 13 show the crimping members 2 and 3 in a closed or engaged position. The crimping members 2 and 3 shown in FIGS. 1-9 show the crimping edges as being substantially straight and level. The crimping edges 20 and 21 shown in FIGS. 11-13 each have respective male and female elements which allow for crimping of conduits of different size and thickness. FIG. 11 shows the crimping edges 20 and 21 as bow-shaped male and female elements. FIG. 12 shows the crimping edges 20 and 21 as angled notched male and female elements. FIG. 13 shows the crimping edges 20 and 21 as rectangular male and female elements. Each of the male and female elements shown in FIGS. 11-13 are described for purposes of example only. The crimping members 2 and 3 can be formed with crimping edges 20 and 21, respectively, in any shape that can be used to effectively stop the flow of liquid or gas through a conduit when used in conjunction with the operation of the tool 1.

Figure 14:
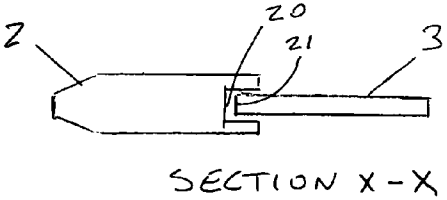
FIG. 14 is a cross sectional view of the crimping section of the Emergency Flow Stoppage Tool taken along the line labeled X-X in FIGS. 11-13.

FIG. 14 is a cross sectional view of the crimping section of the tool taken along the line labeled X-X in FIGS. 11-13. The first crimping member 2 and second crimping 3, of the crimping section 17, may have respective female and male crimping edges 20 and 21. In this figure, the crimping member 2 is shown having a female crimping edge 20 including a recess for receiving the male crimping edge 21 of the second crimping member 3. Alternatively, the second crimping member 3 may include a female crimping edge 21 for receiving a male crimping edge 20 of the first crimping member 2. Additionally, as discussed above the crimping edges 20 and 21 may be flat and have a surface area sufficient to prevent a conduit positioned therebetween from being cut or severed. Upon operating the tool as discussed above, a conduit (not shown) may be crimped between the first edge 20 and the second edge 21. The configuration shown herein further improves the seal formed when the conduit is crimped by the crimping section. The walls of the conduit are caused to have a U-shaped seal which provides an enhanced seal for stopping and/or reducing the flow and/or gas flowing through the conduit. The male-female connection shown in FIG. 14 may be applied and used with any of the crimping configurations shown in FIGS. 11-13 or with the crimping members 2 and 3 shown in FIGS. 1-9.

The tool described in FIGS. 1-14 will be inexpensive to manufacture and is intended for use by users having minimal training. The tool may be used to halt the flow of a plurality of different liquids and or gases (depending on temperature, pressure and combustibility) in any conduit made from a malleable material. The tool will find uses in various types of buildings, homes, boats, ships and machines, and may be used by contractors, maintenance personnel, facility engineering departments, property management personnel and lay people.

It will be understood that each of the elements described above, or two or more together may also find a useful application in other types of devices differing from the type described above.

While certain novel features have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A locking mechanism for tools that crimp an object, such tool including:

a head section, said head section comprised of:

a first head member, and a second head member, and a connection point enabling pivotal engagement of said first head member with said second head member, and a handle section, said handle section comprised of a first handle member, and a first connector connecting said first handle member to said first head member, and a second handle member, and a second connector connecting said second handle member to said second head member, and a third connector, pivotally connecting said first handle member to said second handle member, and the locking mechanism being comprised of a threaded bolt, and a first lock bar, said first lock bar including a first plate extension positioned on a front side of said first and said second head members, and a second plate extension positioned on a back side of said first and said second head members whereby said first and second plate extensions are each connected to said first and said second head members connecting said first and said second head members together at a common geared area, and locking said lock bar in place with respect to said head section, and a male connector, at an end opposite said plate extensions, said male connector including an oblong shaped channel, and a threaded aperture to receive said threaded bolt, and a second lock bar, said second lock bar including a female receptor, at a first end, to accept said male connector of said first lock bar, and a channel through said female receptor, said channel to accept said connector pivotally connecting said first handle member to said second handle, and an aperture, at a second end opposite the first end, to accept said threaded bolt; and said first and second lock bars being aligned such that said female receptor of said second lock bar accepts said male connector of said first lock bar, thus said channel of said female receptor together with said third connector pivotally connecting said first handle member and said second handle member, said channel of female receptor having accepted said third connector pivotally connecting said first handle member and said second handle member, align in and are able to travel along the long axis of said oblong channel of said male connector during operation of the said tool, and when said tool is in the closed position, and an object has been crimped between said first head member and said second head member, said threaded bolt is received by said aperture of said second lock bar and aligned and screwed into said aperture of said first lock bar, rigidly attaching said first lock bar and said second lock bar to one another, and said first lock bar is rigidly attached to said head section, and rigidly attaching said first and said second lock bars to one another selectively locks the position of said channel of said female receptor in said second lock bar, and selectively locking the position of said channel of said female receptor selectively locks the position of the third connector pivotally connecting said first and second handle members, and selectively locking the position of said third connector pivotally connecting said first and second handle members selectively locks the position of said connectors that connect said first and second handle members to said first and second head members, and selectively locking the position of said first and second connectors that connect said first and said second handle members to said first and said second head members, respectively, selectively locks a position of said first and said second head members, and wherein the locking mechanism releasably secures a position of said third connector that pivotally connects said first and second handle members preventing movement of said third connector along the long axis of the tool thus preventing movement of said first connector and second connector connecting said first and second handle members to said first and second head members and, in turn, preventing movement of said first and second head members when the tool is in the closed position.

2. The locking mechanism as recited in claim 1, wherein the locking mechanism secures the position of said third connector that pivotally connects said first and second handle members relative to the head section preventing movement of said third connector along the long axis of the tool thus preventing movement of said third connectors connecting said first and second handle members to said head members and, in turn, preventing movement of said head members when the tool is in the closed position.

3. The locking mechanism as recited in claim 1, wherein the tool is a crimping tool wherein a force applied by each of said first and second head members to a conduit positioned therebetween causes the conduit to collapse on itself.

4. A tool for holding an object, such tool including:

a head section, said head section comprised of:

a first head member, and a second head member, said first and said second head members to hold an object therebetween, and a connection point enabling pivotal engagement of said first head member with, and a handle section, said handle section comprised of a first handle member, and a first connector connecting said first handle member to said first head member, and a second handle member, and a second connector connecting said second handle member to said second head member, and a third connector, pivotally connecting said first handle member to said second handle member, and a locking mechanism, said locking mechanism comprising a threaded bolt, and a first lock bar, said first lock bar including a first plate extension positioned on a front side of said first and said second head members, and a second plate extension positioned on a back side of said first and said second head members whereby said first and second plate extensions are each connected to said first and said second head members connecting said first and said second head members together at a common geared area, and locking said lock bar in place with respect to said head section, and a male connector, at an end opposite said plate extensions, said male connector including an oblong shaped channel, and a threaded aperture to receive said threaded bolt, and a second lock bar, said second lock bar including a female receptor, at a first end, to accept said male connector of said first lock bar, and a channel through said female receptor, said channel to accept said connector pivotally connecting said first leg to said second handle, and an aperture, at a second end opposite the first end, to accept said threaded bolt; and said first and second lock bars being aligned such that said female receptor of said second lock bar accepts said male connector of said first lock bar, thus said channel of said female receptor together with said third connector pivotally connecting said first handle member and said second handle member, said channel of female receptor having accepted said third connector pivotally connecting said first handle member and said second handle member, align in and are able to travel along the long axis of said oblong channel of said male connector during operation of the said tool, and when said tool is in the closed position, and an object is being held between said first head member and said second head member, said threaded bolt shall be inserted into said aperture of said second lock bar and aligned and screwed into said aperture of said first lock bar, rigidly attaching said first lock bar and said second lock bar to one another, and said first lock bar is rigidly attached to said head section, and rigidly attaching said first and said second lock bars to one another shall lock the position of said channel in said second lock bar, and locking the position of said channel in said second lock bar shall lock the position of the third connector pivotally connecting said first and second handle members, and locking the position of said third connector pivotally connecting said first and second handle members shall lock the position of said first and second connectors that connect said first and second handle members to said first and second head members, respectively, and locking the position of said first and second connectors that connect said first and said second handle members to said first and said second head members, respectively, shall lock the position of said first and said second head members.

5. The tool as recited in claim 4, wherein the locking mechanism releasably secures the position of said third connector that pivotally connects said first and second handle members preventing movement of said connector along the long axis of the tool thus preventing movement of said first and second connectors connecting said first and second handle members to said crimping head and, in turn, preventing movement of said head members when the tool is in the closed position.

6. The tool as recited in claim 5, wherein the locking mechanism secures the position of said third connector that pivotally connects said first and second handle members relative to the head section preventing movement of said third connector along the long axis of the tool thus preventing movement of said first and second connectors connecting said first and second handle members to said head members and, in turn, preventing movement of said head members when the tool is in the closed position.

7. The tool as recited in claim 4, further comprising a second locking mechanism is located on the handle section for releasably and directly securing the handle members and indirectly securing the head members when the tool is in a closed position and an object has been secured between said first and second head members.

8. The tool as recited in claim 4, further comprising a second locking mechanism is located on the head section for releasably and directly securing the head members.

9. The tool as recited in claim 4, wherein the tool is a crimping tool wherein a force applied by each of said first and second head members to a conduit positioned therebetween causes the conduit to collapse on itself.

10. A tool for holding an object, such tool including:

a head section, said head section comprised of a first head member, and a second head member, said first and said second head members to hold an object therebetween, and a connection point enabling pivotal engagement of said first head member with said second head member, and a handle section, said handle section comprised of a first handle member, and a first connector connecting said first handle member to said first head member, and a second handle member, and a second connector connecting said second handle member to said second head member, and a third connector, pivotally connecting said first handle member to said second handle member, and a locking mechanism, said locking mechanism is comprised of:

a plurality of swing plates, each swing plate having a different length corresponding to a sum of the distance between the first and second handle member and a thickness of the object positioned between said first and second head members, each having a first end rotatably connected to a first handle member and a second end, opposite said first end, having a notch, and a bolt and wing-nut assembly, said bolt and wing nut assembly extending through said second handle member to receive said notch of said second end of a respective one of said plurality of swing plates; and whereby, when said tool is in the closed position and an object has been secured between said first and second head members, said notch in said second end of said respective one of said plurality of swing plates is received by said bolt and wing nut assembly in said second handle member and said wing nut assembly is tightened to secure said first handle member to said second handle member which in turn locks the head members.

11. The tool as recited in claim 10, wherein the tool is a crimping tool wherein a force applied by each of said first and second head members to a conduit positioned therebetween causes the conduit to collapse on itself.

12. A tool for holding an object, such tool including:

a head section, said head section comprised of a first head member, and a second head member, said first and said second head members to hold an object therebetween, and a connection point enabling pivotal engagement of said first head member with said second head member, and a handle section, said handle section comprised of a first handle member, and a first connector connecting said first handle member to said first head member, and a second handle member, and a second connector connecting said second handle member to said second head member, and a third connector, pivotally connecting said first handle member to said second handle member, and a locking mechanism, said locking mechanism is comprised of:

a j-shaped lock bar, said lock bar having a threaded end, and a bent plate, and a wing nut assembly, and a first notch in said first head member that releasably accepts one end of said j-shaped lock bar, and a second notch in said second head member that releasably accepts said bent plate; and whereby, when said tool is in the closed position and a conduit has been crimped between said head members, said j-shaped lock bar is placed over said first notch in said first head member, said bent plate is received by the threaded end of said j-shaped lock bar and placed over said second notch in said second head member, then said wing nut assembly is threaded onto the threaded end of said j-shaped lock bar releasably securing said first head member to said second crimping member.

* * * * *